US009074337B2

(12) United States Patent
Heselden

(10) Patent No.: US 9,074,337 B2
(45) Date of Patent: Jul. 7, 2015

(54) GABION SYSTEM

(75) Inventors: James Heselden, Leeds (GB); Thomas Louis Brand, legal representative, London (GB)

(73) Assignee: HESCO BASTION LIMITED, Leeds (GB)

( * ) Notice: Subject to any disclaimer, the term of this patent is extended or adjusted under 35 U.S.C. 154(b) by 259 days.

(21) Appl. No.: 13/386,722

(22) PCT Filed: Jul. 16, 2010

(86) PCT No.: PCT/GB2010/051168

§ 371 (c)(1),
(2), (4) Date: Jan. 24, 2012

(87) PCT Pub. No.: WO2011/012879

PCT Pub. Date: Feb. 3, 2011

(65) Prior Publication Data

US 2012/0134756 A1 May 31, 2012

Related U.S. Application Data

(63) Continuation-in-part of application No. 12/090,648, filed as application No. PCT/GB2006/050367 on Nov. 1, 2006, now Pat. No. 8,777,514.

(30) Foreign Application Priority Data

Nov. 24, 2005 (GB) ..... 0523925.6
Jul. 28, 2009 (GB) ..... 0913098.0

(51) Int. Cl.
*E02D 29/02* (2006.01)

(52) U.S. Cl.
CPC ..... *E02D 29/0208* (2013.01)

(58) Field of Classification Search
CPC ..... E02D 29/0208
USPC ..... 405/15, 272, 273
See application file for complete search history.

(56) References Cited

U.S. PATENT DOCUMENTS 4,197,963 A * 4/1980 Nerenberg ..... 229/117.32
5,472,297 A * 12/1995 Heselden ..... 405/286

(Continued)

FOREIGN PATENT DOCUMENTS

EP 0466726 B1 11/1995
EP 0768432 A1 4/1997

(Continued)

OTHER PUBLICATIONS

PCT International Search Report, PCT/GB2010/051168, Jul. 28, 2011, 4 Pages.

*Primary Examiner* — John Kreck
*Assistant Examiner* — Jessica H Lutz
(74) *Attorney, Agent, or Firm* — Fenwick & West LLP

(57) ABSTRACT

A gabion system is disclosed which includes a gabion (1) for use in protecting military or civilian installations from weapons assault or from elemental forces such as flood waters, lava flows, avalanches, soil instability, slope erosion and the like. The gabion (1) comprises opposed side walls (2, 3) connected together at spaced intervals by a plurality of partition walls (4,5,6) such that spaces between neighboring pairs of partition walls define, together with the side walls (2,3), compartments (7, 8, 9) of the gabion, adjacent side and partition walls being connected to one another by pivotal connections (41) enabling the gabion to be folded between fully flattened and deployed configurations, the pivotal connections allowing the gabion to fold concertina-wise for storage or transport. The gabion system also comprises a fill material container (1001; 1005; 1015) configured to fit into and extend throughout a compartment (7, 8, 9) when the fill material container (1001; 1005; 1015) is loaded with fill material (1010; 1011; 1018).

7 Claims, 10 Drawing Sheets

(56) References Cited

U.S. PATENT DOCUMENTS

| | | | | |
|---|---|---|---|---|
| 5,582,492 | A * | 12/1996 | Doyle, Jr. | 405/262 |
| 5,636,938 | A | 6/1997 | Ragazzo | |
| 5,647,695 | A * | 7/1997 | Hilfiker et al. | 405/284 |
| 6,299,011 | B1 * | 10/2001 | Rosenfeldt | 220/4.29 |
| 6,450,356 | B1 * | 9/2002 | Alexander et al. | 220/23.91 |
| 6,672,799 | B2 * | 1/2004 | Earl | 405/111 |
| 7,670,082 | B2 * | 3/2010 | Olsta et al. | 405/15 |
| 7,765,744 | B2 * | 8/2010 | Herron | 52/79.5 |
| 7,837,414 | B2 * | 11/2010 | Heseldon | 405/284 |
| 8,206,065 | B2 * | 6/2012 | Heselden | 405/284 |
| 8,209,916 | B2 * | 7/2012 | Herron | 52/79.5 |
| 8,256,168 | B2 * | 9/2012 | Bigger | 52/79.2 |
| 8,596,926 | B2 * | 12/2013 | Heselden | 405/284 |
| 8,777,514 | B2 * | 7/2014 | Heselden | 405/17 |
| 2002/0170844 | A1 * | 11/2002 | Stone et al. | 206/600 |
| 2004/0098817 | A1 | 5/2004 | Reese | |
| 2005/0284080 | A1 * | 12/2005 | Gallego et al. | 52/648.1 |
| 2007/0140598 | A1 | 6/2007 | McGillick, Sr. et al. | |
| 2008/0264546 | A1 * | 10/2008 | Olsta et al. | 156/91 |
| 2010/0290887 | A1 * | 11/2010 | Beale | 414/802 |
| 2012/0137598 | A1 | 6/2012 | Chamoux | |

FOREIGN PATENT DOCUMENTS

| | | | | |
|---|---|---|---|---|
| GB | 2432611 | | 5/2007 | |
| JP | 06057751 | A * | 3/1994 | E02D 17/18 |
| JP | 2003-232023 | A | 8/2003 | |
| KR | 2004-0111216 | A | 12/2004 | |
| WO | WO 90/12160 | A1 | 10/1990 | |
| WO | WO 00/40810 | A1 | 7/2000 | |
| WO | WO 2007/060476 | A1 | 5/2007 | |
| WO | WO 2008/081177 | A1 | 7/2008 | |

* cited by examiner

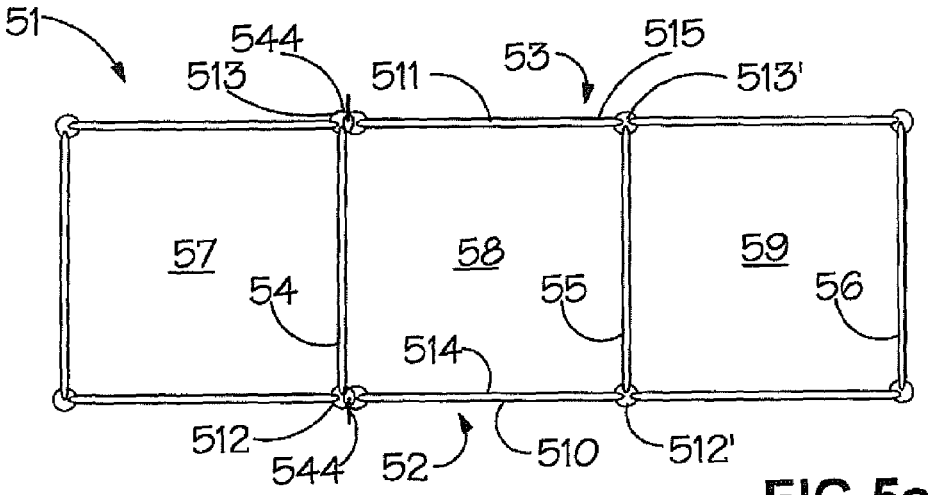
FIG.5a.
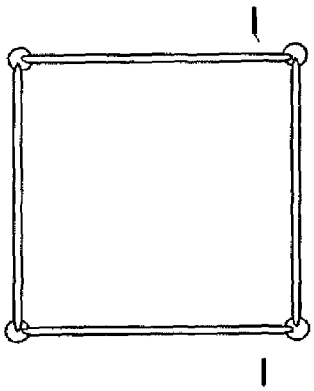
FIG.5b.
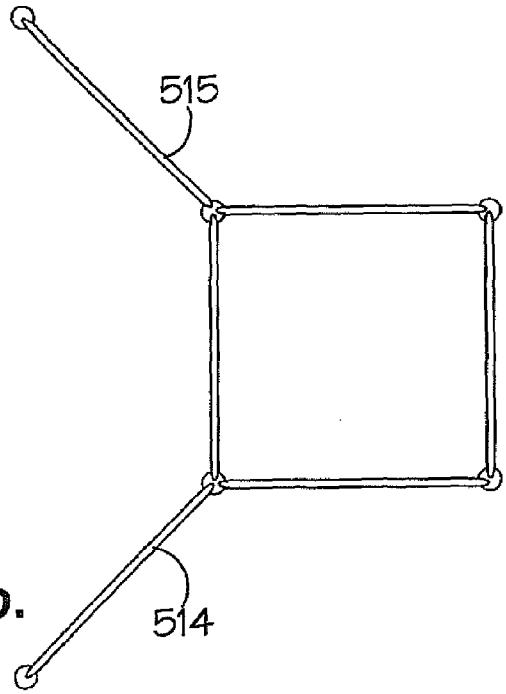
FIG.5c.
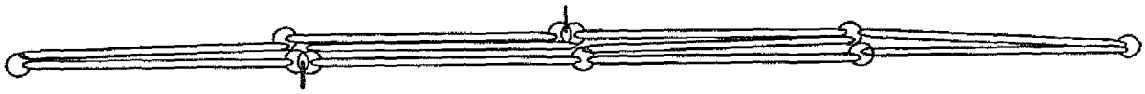

GABION SYSTEM

This application is a continuation-in-part of U.S. patent application Ser. No. 12/090,648, filed May 14, 2008, which is a National Stage entry of PCT Application Serial No. PCT/GB06/50367, filed Nov. 1, 2006, which claims the priority of United Kingdom Application Serial No. 0523925.6, filed Nov. 24, 2005.

Furthermore, this application is a National State entry of PCT Application Serial No. PCT/GB2010/051168, filed Jul. 16, 2010, which claims the priority of United Kingdom Application Serial No. 0913098.0, filed Jul. 28, 2009.

The present invention relates to a gabion system, particularly to gabion system comprising a multi-compartmental gabion.

Gabions are temporary or semi-permanent fortification structures which are used to protect military or civilian installations from weapons assault or from elemental forces, such as flood waters, lava flows, avalanches, slope erosion, soil instability and the like.

Gabions are generally structures of the type which comprise side wall panels, end panels and partition panels which connect the wall panels, and all the panels are usually rectangular and may be pivotally attached, connected together so that the structure can be moved between an expanded (or deployed) condition for use and a collapsed (or folded) condition for storage and transport. In the deployed condition, the structure is elongated and the panels define a row of cavities extending in the length direction of the structure, each cavity being defined by side panels and partition panels, apart from the end cavities which are defined by side panels, partition panels and end panels. These cavities can be filled with ballast or building materials so that the structure turns into a robust wall which can be used for defences for flooding, for military equipment and personnel, and for shoring of hillsides and river banks and the like, or simply as a property or other boundary. They can be used side-by-side, end-to-end or in superimposed relationship, depending upon the use to which they are to be put.

In the folded condition, the structure is basically flat and the partition and end panels lie in parallel planes, whilst the side panels of each side are folded one relative to another in zig-zag or concertina fashion, so that the plan footprint of the collapsed structure is rectangular.

It is to be mentioned that when reference is made to "rectangular" herein, square, which is one form of rectangle, is specifically to be included. For the avoidance of doubt, structures need not be of rectangular configuration either when erect, deployed or in folded configuration.

An example of a structure of the type set forth is illustrated in European Patent No. 0 466 726 B1 in FIGS. 1 and 2 thereof, and an accompanying description is also included in that Patent, the content of which is incorporated herein by reference.

Gabions have been used throughout the world for many different uses, and often in situations where rapid deployment (to prevent flooding, or protect against hostile forces, for example) is necessary. One advantage of the pivotally attached, connected multi-compartmental gabions described in EP-B-0466726 is that they can be relatively easily and quickly erected, and can be filled with readily available and inexpensive material, especially in those embodiments, as described in said European Patent, where the panels are of mesh and have a lining material of geo textile to prevent particles of the filling material from falling through the holes of the mesh. This mesh and lining material construction is a particularly suitable embodiment of the present invention, but embodiments of the invention are not limited to this particular form.

WO-A-90/12160, the content of which is incorporated herein by reference, discloses wire mesh cage structures useful as gabions. The cage structure is made up of pivotally interconnected open mesh work frames which are connected together under factory conditions so that the cage can fold concertina-wise to take a flattened form for transportation to site, where it can be erected to take an open multi-compartmental form for filling with a suitable fill material, such as sand, soil, earth or rocks.

WO-A-00/40810, the content of which is incorporated herein by reference, also concerns a multi-compartmental gabion which folds concertina-wise for transportation, and which comprises side walls extending along the length of the multi-compartmental gabion, the side walls being connected at spaced intervals along the length of the gabion by partition walls which are formed from two releasably connected sections, which after use of the gabion can be released, and the gabion unzipped for recovery purposes.

WO-A-07/060476, the content of which is incorporated herein by reference, discloses a recoverable multi-compartmental gabion which folds concertina-wise for transportation wherein a side wall element may be opened with respect to the gabion to allow access from the side of the gabion to any contents of the gabion compartments.

WO-A-08/081177, the content of which is incorporated herein by reference, discloses a gabion deployment system including a container having a retaining mechanism for retaining a gabion and a multi-compartmental gabion of the folding type. The multi-compartmental gabion is retained in the container through the retaining mechanism and released from the retaining mechanism when the gabion is deployed from the container.

Aspects and embodiments of the present invention were devised with the foregoing in mind.

Viewed from a first aspect there is provided a gabion system, comprising a gabion including opposed side walls connected together by a pair of partition walls defining, together with the side walls, a compartment of the gabion, the partition walls being pivotally connected to the side walls, and the side walls comprising at least one side wall element, the pivotal connections allowing the gabion to fold concertina-wise for storage or transport. The gabion system also comprises a fill material container configured to fit into and extend throughout the compartment when the fill material container is loaded with fill material.

Viewed from a second aspect there is provided a gabion, comprising opposed side wails connected together by at least a pair of partition walls defining, together with the side walls, at least one compartment of the gabion, the partition walls being pivotally connected to the side wails, and the side walls comprising at (east one side wall element, the pivotal connections allowing the gabion to fold concertina-wise for storage or transport; and a loaded fill material container disposed in a compartment the loaded fill material container extending throughout the compartment.

Viewed from a third aspect there is provided a fill material container for a gabion system or gabion, the fill material container configured to extend throughout a compartment of the gabion system or gabion.

The fill material container is configured to extend throughout the volume of the compartment in order to fill the compartment sufficiently completely such that only relatively small gaps are left which may be filled with further fill material.

The provision of a fill material container allows for a filled container to be located in a compartment of a gabion or gabion system. An empty fill material container may be placed in a compartment and filled when in situ, for example when the gabion system is deployed, thereby obviating any need to provide a liner fabric for the walls of the compartment. Optionally, the fill material container may be filled with fill material at a geographically distant location from the location at which a gabion is deployed and the pre-filled container transported to the gabion and placed in a compartment thereof. This is convenient if the deployment location does not have, or has insufficient, fill material in its locale to fill the gabion compartments.

The fill material container may be configured to fill a major part of the volume of the compartment but leave at least one peripheral gap between the fill material container and at least one edge and/or corner of the compartment. In use the at least one peripheral gap may be at least partially filled with a non-containerised fill material.

The fill material container is configured to substantially fill the compartment, for example the fill material container may be configured such that one or more parts thereof extend proximal to one or more of the partition walls and side walls when the fill material container is loaded with fill material and disposed in the compartment. Typically, the fill material container is configured to have at least one side in a touching engagement with one or more of the partition walls and side walls when the fill material container is loaded with fill material and disposed in the compartment. The touching engagement may be in as little as just one place, in several places or along most of a side or partition wall. Such foregoing configurations result in the gabion compartment being filled quickly thereby providing its protective barrier function quickly.

However, the fill material container should be configured such that it may be placed in the compartment when the fill material container is loaded with fill material. A loaded fill material container should not have side walls which bulge such that they interfere with the sides of the gabion compartment when it is attempted to place a filled container in a compartment.

Suitably, the fill material container is configured for placement in the compartment from above the compartment which provides for placement using conventional mechanical equipment and/or aerial supply and placement of the containers.

In one embodiment of a gabion system the pivotal connection between at least one partition wall and side wall element is provided by a hinge member and by a releasable locking member releasably securing the pivotal connection by cooperating with the hinge member, whereby release of the locking member allows a side wall element to be disconnected from a partition wall and to move pivotally, by means of its pivotal connection with an opposite partition wall, with respect to the compartment of the gabion and allow access to any contents of the compartment. Access to the contents of a compartment allows those contents to be removed from the side instead of lifting out from the top of the compartment, for example the fabric of the fill material container may be cut or ruptured so that the fill material can spill out and be dug out thereby facilitating collapse and removal of the gabion from its deployed location.

A gabion system may be configured such that opposed side walls are connected together at spaced intervals along the length of the gabion by a plurality of partition walls, the spaces between neighbouring pairs of partition walls defining, together with the side walls, individual compartments of a multi-compartmental gabion, individual compartments of the multi-compartmental gabion being bounded by opposed side wall sections of the respective opposed side walls. A pivotal connection between at least two neighbouring side wall elements is provided by a hinge member provided on one or both neighbouring side wall elements and a releasable locking member releasably securing the pivotal connection by cooperating with the hinge member, whereby release of the locking member allows a first neighbouring side wall element to be disconnected from a second neighbouring side wall element and for the first side wall element thereby to move pivotally, by means of its pivotal connection with an opposite neighbouring side wall element, with respect to the compartment of the gabion bounded by the first neighbouring side wall element to open the compartment through the side wall of the gabion and allow access to any contents of the compartment.

In a gabion system or gabion configured with an openable side wall the fill material container may be configured for placement in the compartment from a side of the compartment.

Suitably, the fill material container comprises one or more coupling members, such as one or more handles, for releasably coupling the fill material container to a placement mechanism for placing the fill material container in the compartment.

The fill material container may be made of a flexible material for example so that it may be configured to be collapsible when empty.

The gabion system or gabion have pivotal connections which cause adjacent walls of the gabion to fold about a plurality of pivot axes. Suitably, the pivot axes are spaced apart to enable adjacent walls to lie face-to-face when the gabion is in a folded configuration which provides for a convenient arrangement in which the gabion system or gabion may be transported.

The gabion system or gabion may have each side wall sections comprising a single side wall element or a plurality of side wall elements.

The gabion system or gabion may have at least one compartment lined with a fabric. Lining a compartment with a fabric, or at least the side walls with a fabric, means that fill material which would otherwise fall through the gaps in the wire grid making up the walls of the gabion are retained. Viewed from a fourth aspect there is provided a method of placing fill material in a compartment of a gabion of a gabion system, the method comprising: loading a fill material container with fill material to form a loaded fill material container; and placing the loaded fill material container in the compartment.

The loaded fill material container may be placed in the compartment from a position above the compartment or from a position at a side of the compartment.

The fill material may be selected from a group including sand, earth, soil, stones, rocks, rubble, concrete, debris, snow, ice and combinations of two or more thereof.

The method may further comprise filling a space between an edge of the fill material container and a wall partition or side wall of the gabion with second fill material. Typically, the second fill material has a different provenance to the fill material of the fill material container. For example, the second fill material may be sourced from the locality of the deployed gabion.

Specific embodiments in accordance with the invention will now be more particularly described, by way of example only, with reference to the following drawings, in which:

FIG. 5 shows a schematic plan view of a second form of multi-compartmental gabion in accordance with the invention, wherein each side wall section comprises a single side wall element, in expanded (FIG. 5*a*) and partially folded (FIG. 5*c*) configurations, and in expanded configuration with one compartment opened from both sides (FIG. 5*b*);

Figure 2:
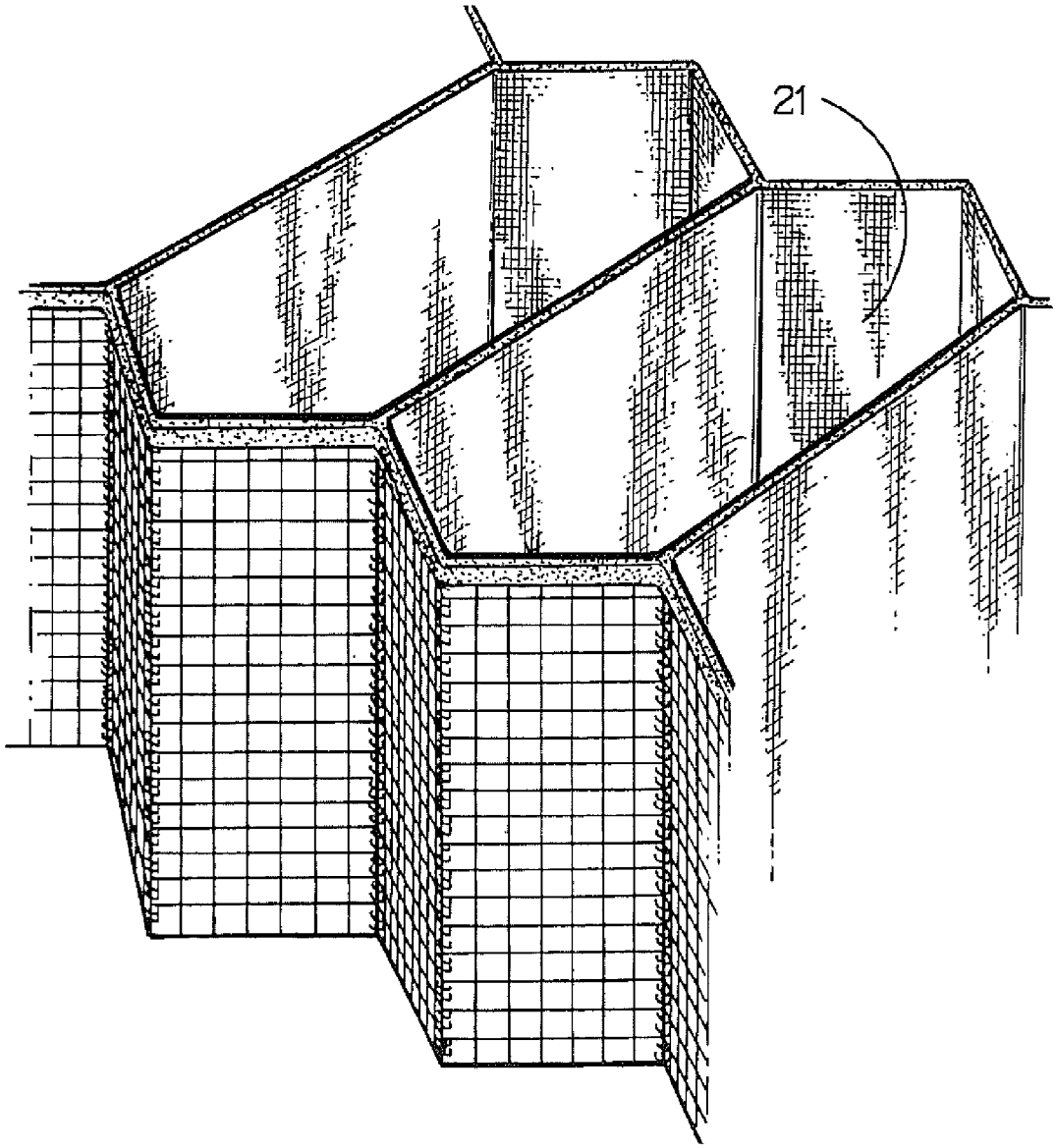
FIG. 2 shows the multi-compartmental gabion of FIG. 1 lined with a geo-textile material.
Figure 10A:
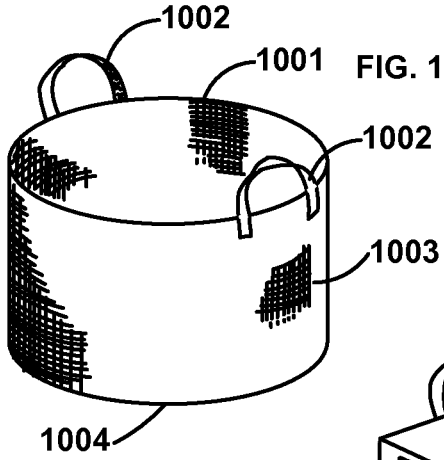
Figure 10B:
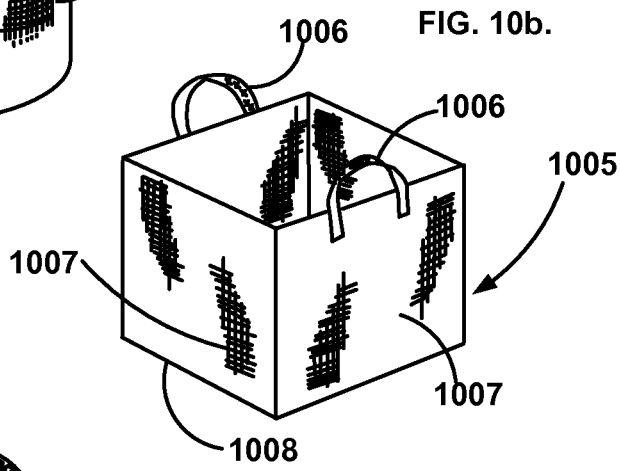
Figure 11A:
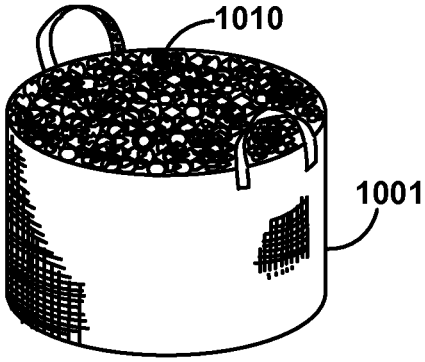
Figure 11B:
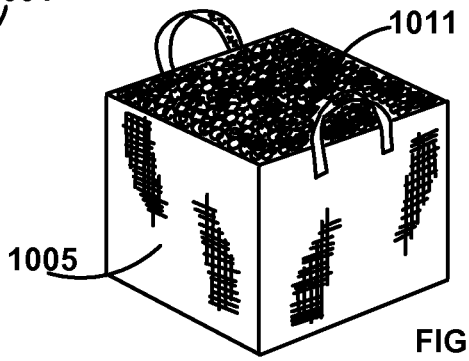
Figure 12:
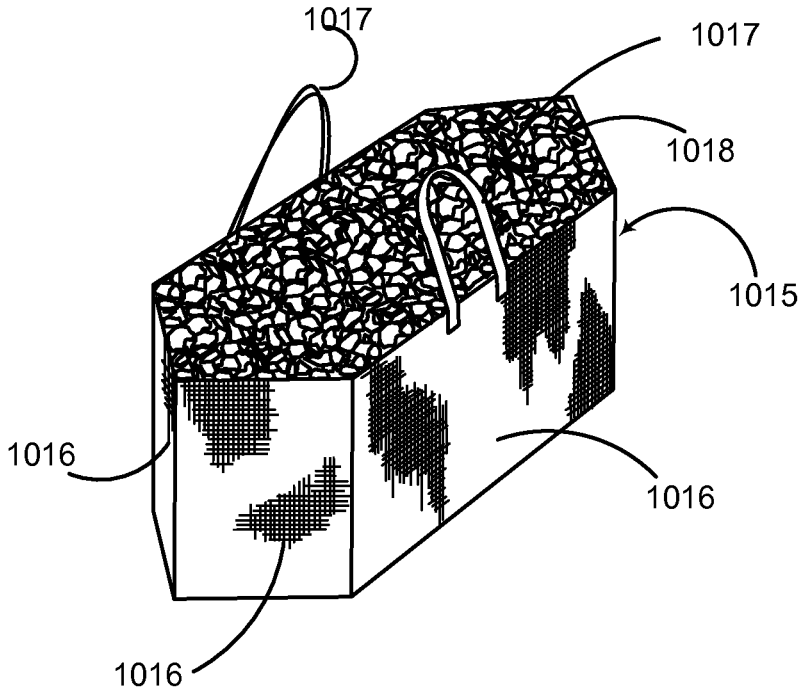
Figure 13:
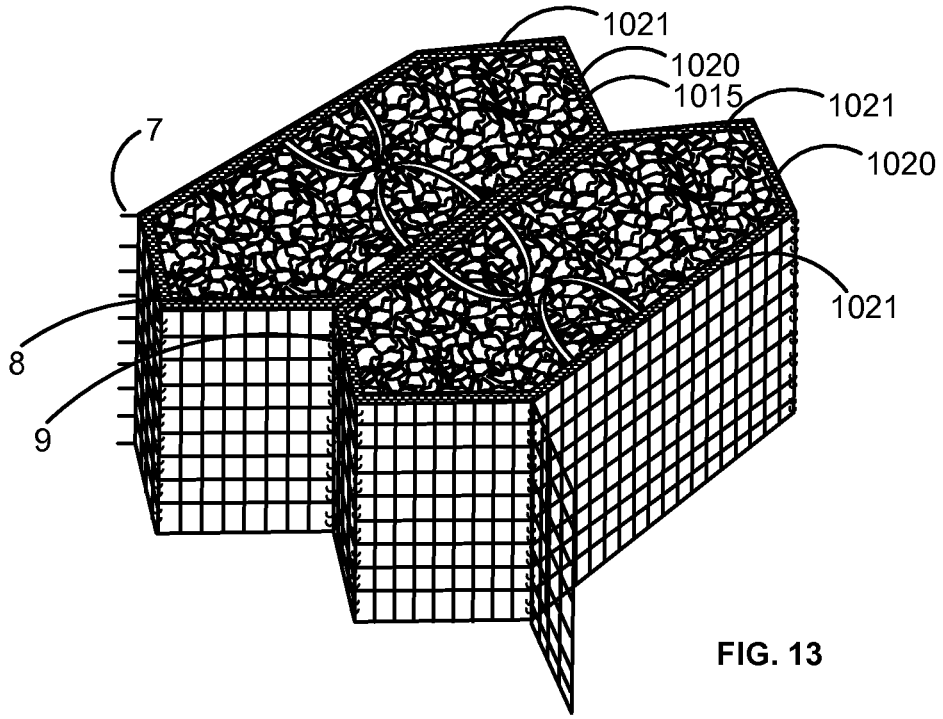

FIG. 10*a* shows a perspective view of a cylindrical fill material container;

FIG. 10*b* shows a perspective view of a square fill material container;

FIG. 11*a* shows a perspective view of the fill container shown in FIG. 10*a* filled with a fill material;

FIG. 11*b* shows a perspective view of the fill container shown in FIG. 10*b* filled with a fill material;

FIG. 12 shows a perspective view of a filled lozenge-shaped fill material container suitable for placing in a compartment of the multi-compartment gabion shown in FIG. 2; and FIG. 13 shows a perspective view of the multi-compartment gabion shown in FIG. 2 having a filled fill container as shown in FIG. 12 placed in respective compartments.

Figure 1:
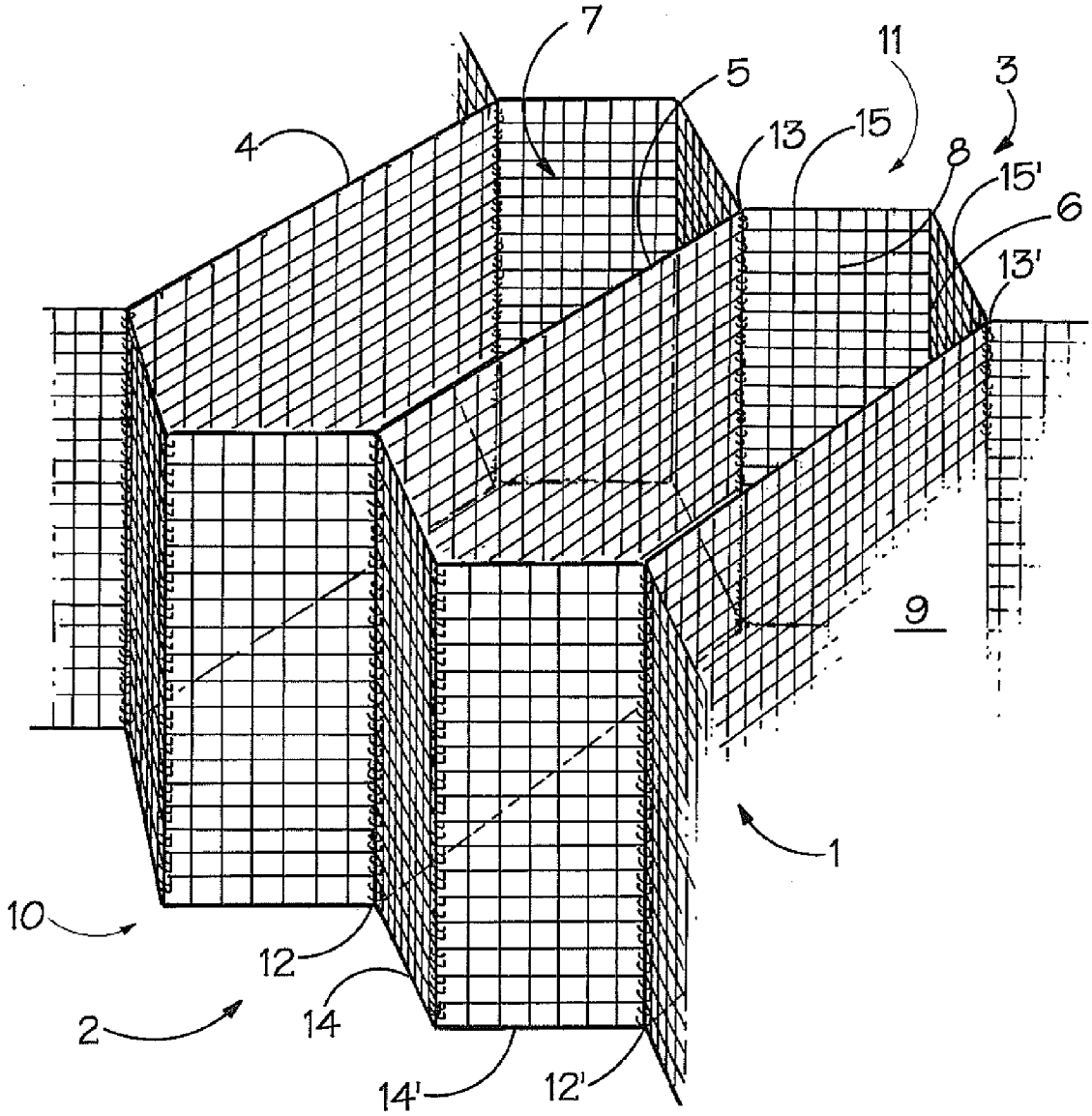
FIG. 1 shows a perspective view of a multi-compartmental gabion in accordance with the invention.
Figure 3:
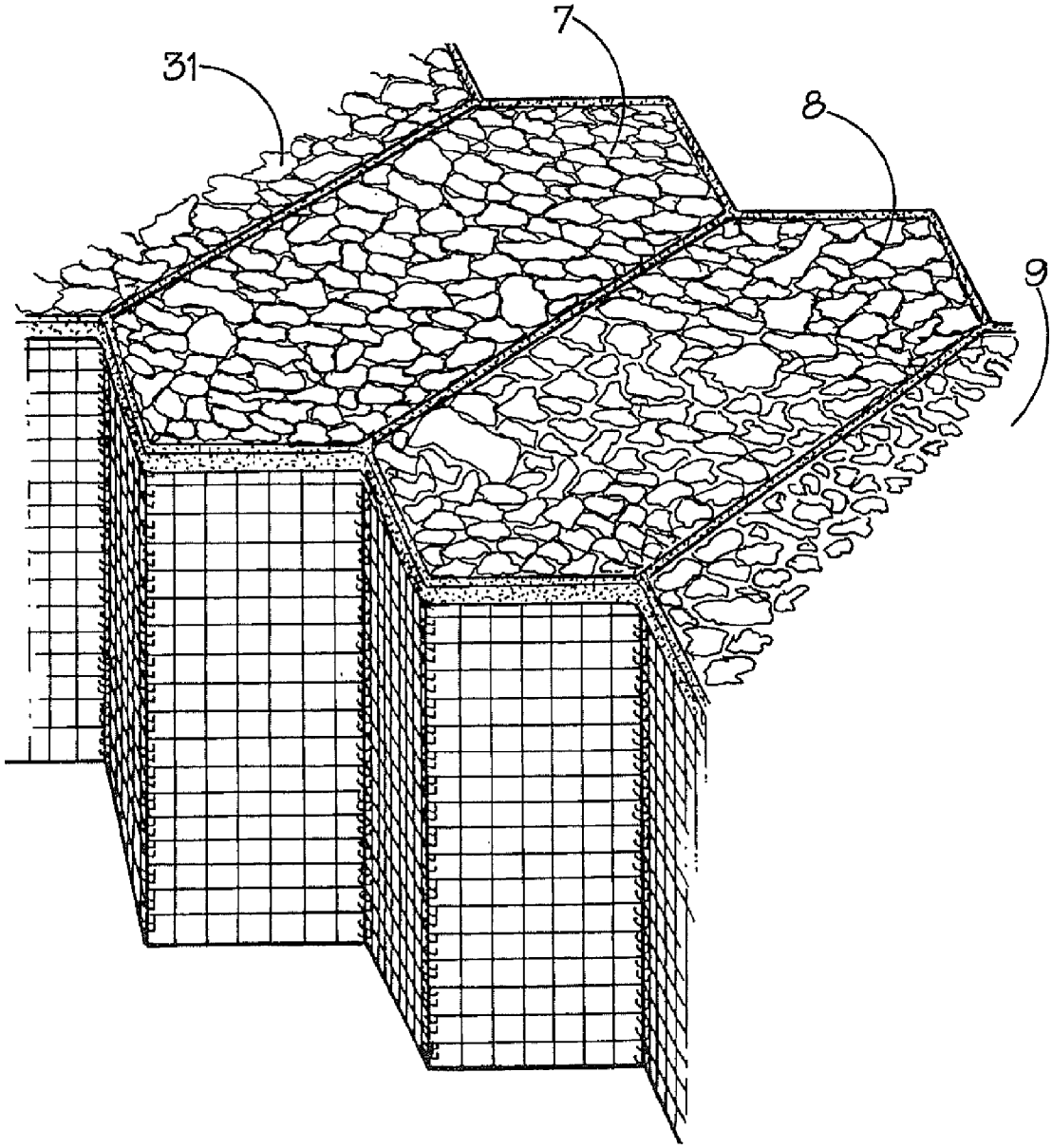
FIG. 3 shows the multi-compartmental gabion of FIG. 2 when filled with a fill material.

Referring in more detail to FIGS. 1, 2 and 3, there is shown multi-compartmental gabion 1 comprising opposed side walls 2, 3 connected together at spaced intervals along the length of gabion 1 by a plurality of partition walls 4, 5, 6 defining, together with side walls 2, 3, individual compartments 7, 8, 9 of multi-compartmental gabion 1. Individual compartment 8 (and other similar individual compartments) of multi-compartmental gabion 1 are bounded by opposed side wall sections 10, 11 of the respective opposed side walls 2, 3. Partition walls 4, 5 (and similar partition walls) are pivotally connected to side walls 2, 3 at hinge points 12, 12'; 13, 13'.

In the embodiment shown in FIGS. 1, 2 and 3, each side wall section 10, 11 of multi-compartmental gabion 1 comprises two side wall elements 14, 14'; 15, 15' with openable pivotal connections being provided between neighbouring side wall elements 14, 14', and between neighbouring side wall elements 15, 15'.

The pivotal connections between partition walls 4, 5 (and other partition walls in the multi-compartmental gabion) and side walls 2, 3, and the openable pivotal connections between neighbouring side wall elements 14, 14'; 15, 15' allow multi-compartmental gabion 1 to fold concertina-wise for flat-packing in transportation and storage. In the embodiment shown in FIGS. 1, 2 and 3, the concertina-wise folding preferably operates so that the openable pivotal connections between neighbouring side wall elements 14, 14'; 15, 15' move inwardly with respect to the longitudinal axis of multi-compartmental gabion 1 so that the width of the flat-packed gabion is at least approximately corresponding to the width of partition walls, 4, 5, 6.

Referring to FIG. 2, multi-compartmental gabion 1 is shown lined with geo-textile liner 21. The lining material of geo-textile liner 21 is of any suitable material, for example woven or non-woven synthetic materials; fibreglass, sisal, jute, coir. In the embodiment shown in FIG. 2, the said lining material is the known geo-textile material sold by Dupont, and which is designed to allow water to pass through the material, but to prevent solid particles which are in a pasty condition from exuding through the material, even although pressed strongly there against. Geo-textile liner 21 may conveniently be folded over the top most edges of the gabion panels and stapled in place (the stapling is not shown in FIG. 2).

Referring to FIG. 3, individual compartments 7, 8, 9 of multi-compartmental gabion 1 are shown filled with fill material 31. Fill material 31 may be selected from any suitable available material, as hereinbefore described. Rough earth and stones are shown as the fill material in FIG. 3.

Figure 4A:
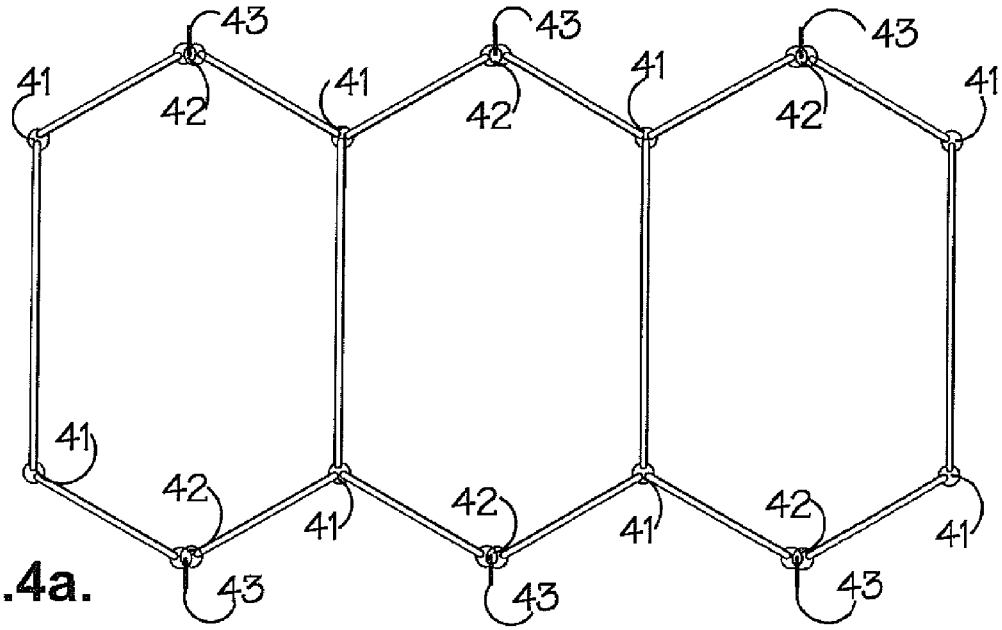
FIG. 4 shows a schematic plan view of the multi-compartmental gabion of FIG. 1 in expanded (FIG. 4*a*), partially folded (FIG. 4*b*) and fully folded (FIG. 4*c*) configurations.
Figure 4B:
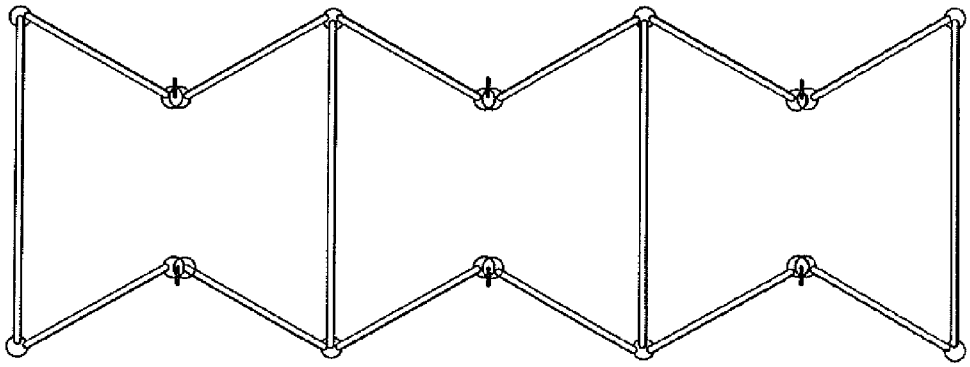
Figure 4C:
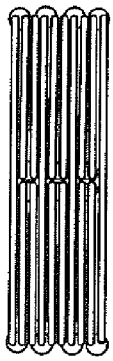

Referring to FIG. 4*a* there is shown in schematic plan view the multi-compartmental gabion in which the pivotal connections between neighbouring compartments are indicated by multiple reference numerals 41, whilst the openable pivotal connections between neighbouring side wall elements are indicated my multiple reference numerals 42. Locking pins 43 may also be seen in FIG. 4*a*. The partially folded gabion is shown in FIG. 4*b*, whilst the fully folded gabion is shown in FIG. 4*c*.

Referring to FIG. 5*a* there is shown in schematic plan view a second form of multi-compartmental gabion 51 comprising opposed side walls 52, 53 connected together at spaced intervals along the length of gabion 51 by a plurality of partition walls 54, 55, 56 defining, together with side walls 52, 53, individual compartments 57, 58, 59 of multi-compartmental gabion 51. Individual compartment 58 (and other similar individual compartments) of multi-compartmental gabion 1 are bounded by opposed side wall sections 510, 511 of the respective opposed side walls 52, 53. Partition walls 54, 55 (and similar partition walls) are pivotally connected to side walls 52, 53 at hinge points 512, 512'; 513, 513'. However, unlike the FIG. 1 gabion, each side wall section 510, 511 comprises a single side wall element 514, 515, with openable pivotal connections being provided at the junction between the side wall sections and the partition walls, and secured by locking pins 544. FIG. 5*b* shows the gabion when locking pins 544 are removed and side wall elements 514, 515 are moved pivotally to open the gabion compartment 58 from the side. A closed and partially folded configuration of the gabion is shown in FIG. 5*c*. The partially folded gabion shown in FIG. 5*c* may be folded again concertina-wise at the pivot points for flat packing and transportation. In FIG. 5 there is shown an alternative embodiment of a multi-compartmental gabion in accordance with the invention, wherein each side wall section 510, 511 comprises a single side wall element 514, 515. In the embodiment shown in FIG. 5, openable pivotal connections (of the type shown below in FIGS. 7 and 8) are provided between partition wall 55 (and other similar partition walls) and neighbouring side wall elements 514 (and other similar neighbouring side wall elements) and 515 (and other similar neighbouring side wall elements).

Figure 6:
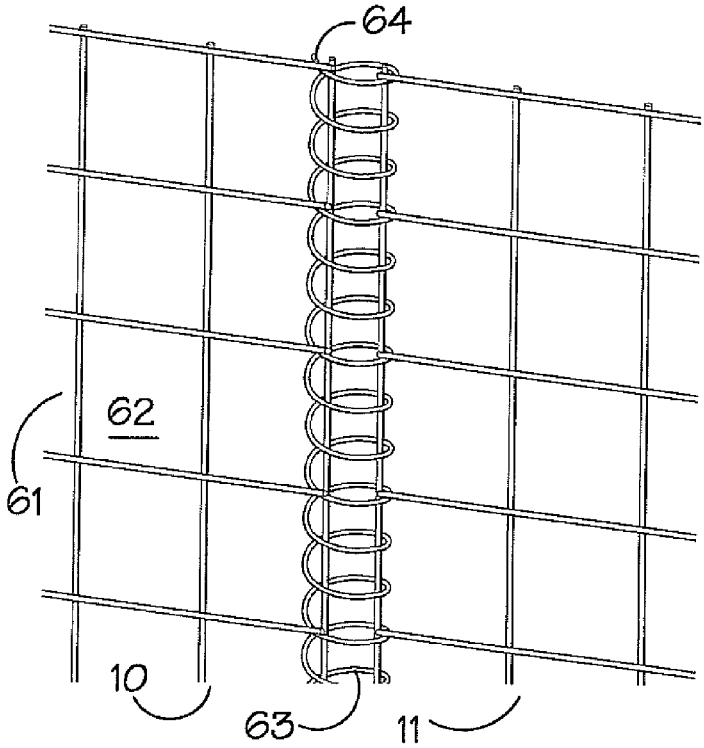
FIG. 6 shows in close-up perspective view the pivotal connection between neighbouring side wall elements of the gabion of FIGS. 1 to 5.

Referring now to FIG. 6 there is shown a close-up perspective view of the pivotal connection between neighbouring side wall sections 10 and 11. For convenience in the drawing, partition wall 5 has been omitted from the close-up perspective view. However, it will be understood that partition wall 5 also shares in this particular pivotal connection in a similar fashion. Referring to FIG. 6, side wall section 10 comprises an open mesh work panel 61 comprising a mesh work lattice of square apertures 62. Although the entire side wall section is not shown in FIG. 6, the expanded view shows clearly the neighbouring mesh work frames of neighbouring side wall sections 10 and 11. Pivotal connection therebetween is effected by helical coil 63 which is helically threaded through the mesh apertures of the neighbouring panels. Although not shown in FIG. 6, loose end 64 of helical coil 63 may be bent round or otherwise prevented from accidentally disengaging with the top most mesh aperture of side wall section 10, 11 and weakening the pivotal connection by such disengagement.

Figure 7:
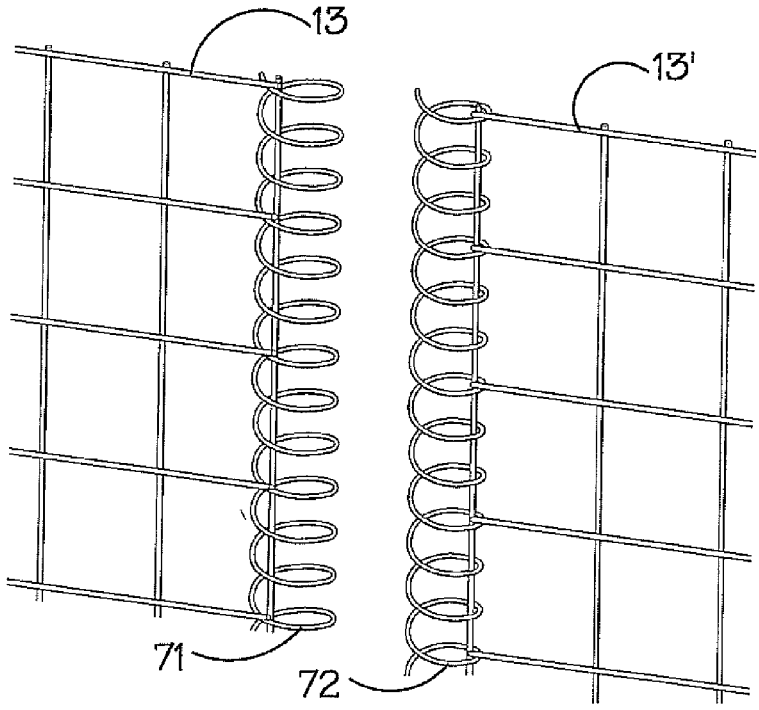
FIG. 7 shows in close-up perspective view the openable pivotal connection between neighbouring side wall elements of the multi-compartmental gabion of FIGS. 1 to 5 before the releasably locking member is installed.
Figure 8:
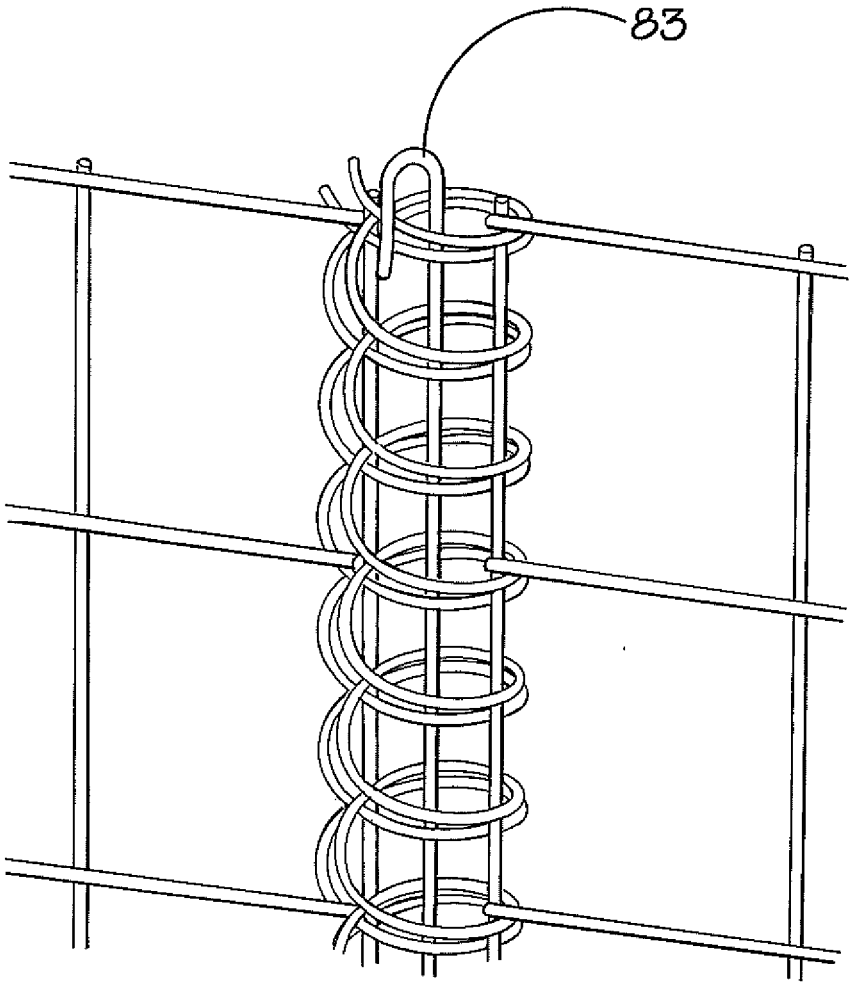
FIG. 8 shows in close-up perspective view the openable pivotal connection when made between the components of the FIG. 7 drawing.

Referring now to FIG. 7, there is shown in close-up perspective view the openable pivotal connection between neighbouring side wall elements 13, 13'. In this case, both neighbouring mesh work panels are provided with helical coil members threaded helically through the mesh work panel apertures thereof. The first hinge member 71 and second member 72 are thereby provided. The connected and releasably locked equivalent is shown in FIG. 8, locking being effected by releasable locking pin 83.

Figure 9:
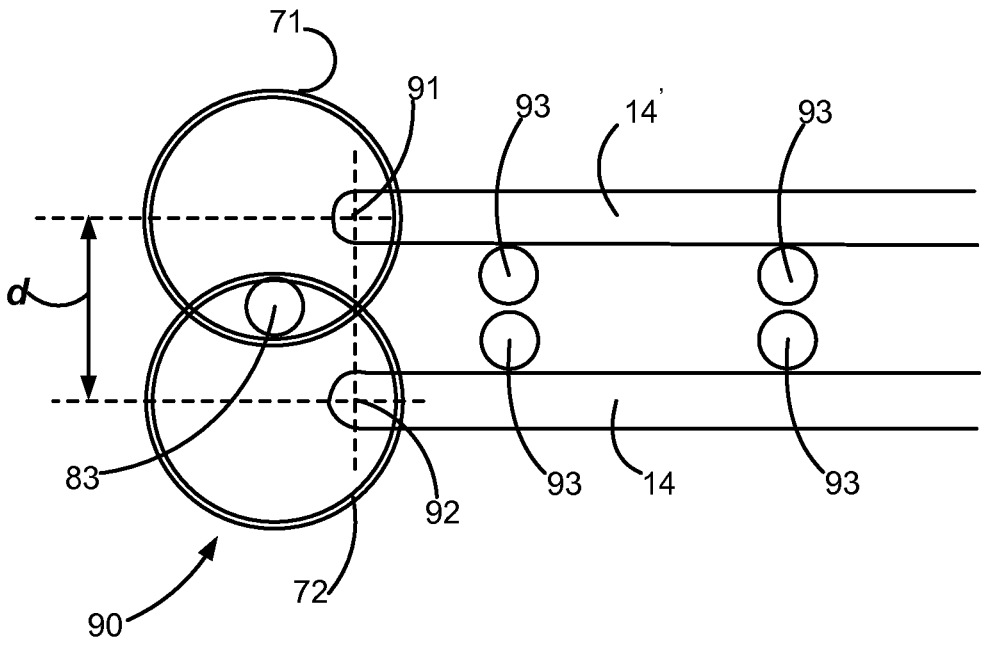
FIG. 9 shows a schematic plan view of a pivotal connection having spaced apart pivot axes.

Finally, FIG. 9 shows how the gabion can be folded substantially flat for storage. The pivotal connection 90 between adjacent, say, side wall elements 14, 14' consists of a pair of helical springs 71, 72 connected by way of a connection member 83 as previously described. This arrangement means that the side wall elements 14, 14' pivot about pivot axes 91, 92 that are spaced apart by a distance d. Distance d is greater than the thickness of the side walls 14, 14' and any protuberances (e.g. vertical wire members 93) such that the side wall elements 14, 14' can lie in a face-to-face relationship to one another.

FIG. 10 illustrates two embodiments of a fill material container in accordance with the invention. FIG. 10*a* illustrates a tubular shaped container 1001, having handles 1002 for coupling or attaching to a lifting mechanism such as a may be provided by mechanical excavating equipment or other forms of lifting equipment. The side wall 1003 of the cylindrical container is capped at one end by a floor wall 1004 and open at the other end to allow for the ingress of fill material. In the illustrated embodiment the walls of the container 1001 are made of a flexible fabric strong enough to support and contain fill material when it is loaded into the container, for example a woven polypropylene fabric. The fabric may be flexible or semi rigid to allow the container to collapse or be folded when not in use or rigid.

FIG. 10*b* illustrates an embodiment of a fill container 1005 having a cuboid, square or rectangular, configuration, open at one end with side walls 1007 and floor wall 1008. The container 1005 also has handles 1006. The walls of container 1005 may be made of fabric such as described with reference to FIG. 10*a*.

FIG. 11*a* illustrates the container 1001 of FIG. 10*a* filled with fill material 1010 and FIG. 11*b* illustrates the container 1005 of FIG. 10*b* filled with fill material 1011.

Turning now to FIG. 12, a lozenge-shaped fill material container 1015 is illustrated filled with fill material 1018. The lozenge-shaped container 1015 is configured to fit into a compartment of the multi-compartmentalised gabion 1 illustrated in FIG. 12. The container 1015 has side walls 1016, handles 1017 and floor wall 1019.

FIG. 13 illustrates a gabion 1 having filled containers 1015 as described with reference to FIG. 12 placed into individual compartments 7, 8 and 9 of gabion. The containers 1015 may be pre-filled with fill material 1018 at a location geographically distant from the location at which the gabion 1 is deployed., For example, the containers 1015 may be filled at a location which has a plentiful supply of suitable fill material 1018. This is particularly useful if the deployment location of the gabion 1 has little suitable fill material available. Pre-filled containers 1015 may be transported from the location at which they were filled to the deployment location of the gabion 1 and placed into the individual compartments 7, 8, 9 of the gabion 1. Thus, not only may the gabion compartments be filled with fill material when in a location which may have insufficient fill material to fill the compartments, but the compartments may also be filled relatively quickly by placing filled containers 1015 into the compartments effectively "filling" them in one operation.

Pre-filled containers 1015 may be placed in the compartments 7, 8, 9 from above or through an open side wall. Placing containers from above provides for aerial supply of containers such as from helicopters, as well as by lifting mechanisms.

Although the container 1015 is configured to fill as much of a compartment as possible when the container is filled, in practice there will be interstitial spaces 1020 formed between the sides of the container and the compartment walls. Such spaces may be weaknesses in the barrier function of the gabion 1. The spaces 1020 can be filled with a fill material obtained from the local vicinity of the gabion 1 when it is employed and loaded with pre-filled containers 1015. It is therefore possible that the locally sourced fill material 1021 used to fill the interstitial spaces 1020 is different from the fill material 1018 in the containers.

In an embodiment of the gabion 1 having openable side walls, it is possible to access the fill container 1015 though an open side wall to cut or rupture the fabric of the container 1015 to release its contents in order to facilitate removal, relocation or recovery of the gabion 1. Optionally, the container 1015 may be lifted out of the compartment either from above or from the side while still filled.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the invention. This is done merely for convenience and to give a general sense of the invention. This description should be read to include one or at least one and the singular also includes the plural unless it is obvious that it is meant otherwise.

In view of the foregoing description it will be evident to a person skilled in the art that various modifications may be made within the scope of the invention. For example, embodiments in accordance with the invention are not limited to any of the particular materials disclosed herein, Other materials suitable for performing the function described herein for a particular material may also be utilized in embodiments of the invention.

The scope of the present disclosure includes any novel feature or combination of features disclosed therein either explicitly or implicitly or any generalisation thereof irrespective of whether or not it relates to the claimed invention or mitigate against any or all of the problems addressed by the present invention. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

The invention claimed is:

1. A method of placing fill material in the at least one compartment of a gabion of a gabion system, the method comprising:

providing the gabion system comprising:

opposed side walls connected together by at least a pair of partition walls defining, together with the side walls, at least one compartment of the gabion, the partition walls being pivotally connected to the side walls, and the side walls comprising at least one side wall element, the pivotal connections allowing the gabion to fold concertina-wise for storage or transport, and a loaded fill material container configured to be placed in the at least one compartment, the loaded fill material container extending throughout the at least one compartment;

transporting the gabion to a deployment site in a folded configuration;

unfolding the gabion at the deployment site, the unfolding comprising:

unfolding the at least one compartment into a hexagonal or rectangular shape by concertina-wise expanding the opposed side walls with respect to the connected pair of partition walls when compared to the compartment being folded;

loading the fill material container with fill material to form a loaded fill material container at a location different from the deployment site, the loaded fill material container having a shape that matches the hexagonal or rectangular shape of the unfolded compartment of the gabion;

transporting the loaded fill material container to the deployment site without the fill material container changing its shape; and placing the loaded fill material container in the compartment.

2. The method according to claim 1, wherein the loaded fill material container is placed in the compartment from a position above the compartment.

3. The method according to claim 1, wherein the loaded fill material container is placed in the compartment from a position at a side of the compartment.

4. The method according to claim 1, wherein the fill material is selected from sand, earth, soil, stones, rocks, rubble, concrete, debris, snow, ice and combinations of two or more thereof.

5. The method according to claim 1, further comprising filling a space between an edge of the fill material container and a wall partition or side wall of the gabion with second fill material.

6. The method according to claim 5, wherein said second fill material has a different provenance to the fill material of the fill material container.

7. The method according to claim 1, wherein the unfolding of the at least one compartment into the hexagonal or rectangular shape comprises inverting the opposed side walls from facing inside to facing outside with respect to the connected pair of partition walls when compared to the compartment being folded concertina-wise.

* * * * *